US005203052A

United States Patent [19]

Hardy et al.

[11] Patent Number: 5,203,052

[45] Date of Patent: Apr. 20, 1993

[54] NOISE SUPPRESSION BOX FOR FIBER PROCESSING MACHINERY

[75] Inventors: William M. Hardy, Victor; Michael A. Ruffalo, Newark, both of N.Y.

[73] Assignee: Phoenix Associates, Victor, N.Y.

[21] Appl. No.: 716,298

[22] Filed: Jun. 17, 1991

[51] Int. Cl.[5] ..... D01B 3/00; G10K 11/04

[52] U.S. Cl. ..... 19/205; 181/200

[58] Field of Search ..... 19/98, 109, 115 B, 200, 19/205; 181/200, 198, 289

[56] References Cited

U.S. PATENT DOCUMENTS

| | | | |
|---|---|---|---|
| 3,685,614 | 8/1972 | Coanda et al. | 181/259 X |
| 4,043,008 | 8/1977 | Weiss et al. | 181/200 X |
| 4,110,876 | 9/1978 | Weiss et al. | 181/200 X |
| 4,129,264 | 12/1978 | Lamin et al. | 181/200 X |
| 4,854,013 | 8/1989 | Pinto et al. | 19/200 |
| 4,964,196 | 10/1990 | Schmid et al. | 19/200 |
| 5,033,165 | 7/1991 | Temburg et al. | 19/200 X |
| 5,044,046 | 9/1991 | Pinto et al. | 19/205 X |
| 5,095,588 | 3/1992 | Hergeth | 19/205 |

*Primary Examiner*—Clifford D. Crowder
*Assistant Examiner*—John J. Calvert
*Attorney, Agent, or Firm*—Shlesinger, Fitzsimmons & Shlesinger

[57] ABSTRACT

A noise supression box is secured over the air inlet opening in the housing of a fiber opening machine which contains a plurality of rotatable opener rolls that open and feed fibers to an outlet formed in the housing adjacent its air inlet opening. The box surrounds in spaced relation thereto an air inlet duct which is secured at one end over the air inlet opening and communicates at its opposite end with the exterior of the box and housing. The walls of the air inlet duct contain a plurality of spaced perforations, and the space in the box around the outside of the duct is filled with sound absorbing foam insulation.

9 Claims, 2 Drawing Sheets

NOISE SUPPRESSION BOX FOR FIBER PROCESSING MACHINERY

BACKGROUND OF THE INVENTION

This invention relates to apparatus for reducing the noise created by fiber processing machinery, and more particularly to a specially designed box for enclosing machinery which operates to open, blend and clean various fibers.

The initial step in the preparation of non-woven or random fiber webs is the opening or separation of fibrous tufts or stock into individual or nearly individual fibers which can be airborne to various carding machines and the like. The machine which is utilized for opening the incoming fibrous material generates a substantial amount of noise during its operation. This is particularly true in the case of opener and blender machines which contain a series of toothed opener and blender rolls that rotate at relatively high speeds in order to separate fibers. Many such machines include also an air inlet for admitting an air stream that flows through the machine to convey opened fibers to a pneumatic fiber distributing system.

Heretofore it has been customary to enclose most of the operating portions of machines of the type described within some form of cover or housing, both to protect against accidental injury to employees during machine operation, and also to reduce noise pollution to some extent. However, a major problem with such a machine is the fact that a substantial amount of noise is still emitted from the air inlet to the machine; and in many instances the noise proves to be more concentrated in the vicinity of the air inlet. The resulting noise pollution can be debilitating to the health of employees who must work near by such machinery.

Accordingly, it is an object of this invention to provide for machinery of the type described a novel noise reduction or suppression unit, which is capable of reducing by a high percentage the noise otherwise generated by such machinery during its operation.

A more specific object of this invention is to provide for machinery of the type described a novel noise reduction box which is designed to be secured over the air inlet of a machine of the type described, and to absorb most of the noise emitted therefrom.

Other objects of the invention will be apparent hereinafter from the specification and from the recital of the appended claims, particularly when read in conjunction with the accompanying drawings.

SUMMARY OF THE INVENTION

A fiber opener machine of the type which contains a number of rotating, toothed slivers or combing drums has in one end thereof an air inlet opening which is covered by a novel is noise suppression box. The box is adapted to be attached to the existing machine cover or housing, and contains a duct which is enclosed in a sound-absorbing foam insulation which absorbs much of the noise and vibration generated in the machine housing.

THE DRAWINGS

PREFERRED EMBODIMENTS OF THIS INVENTION

Figure 1:
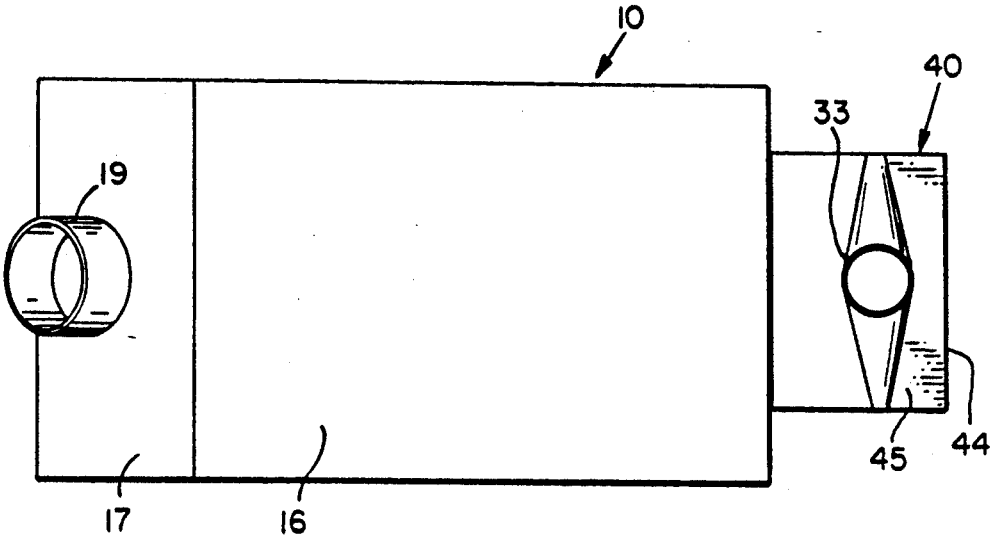
FIG. 1 is a plan view of a fiber opener machine having mounted thereon a novel noise suppression box made according to one embodiment of this invention.
Figure 2:
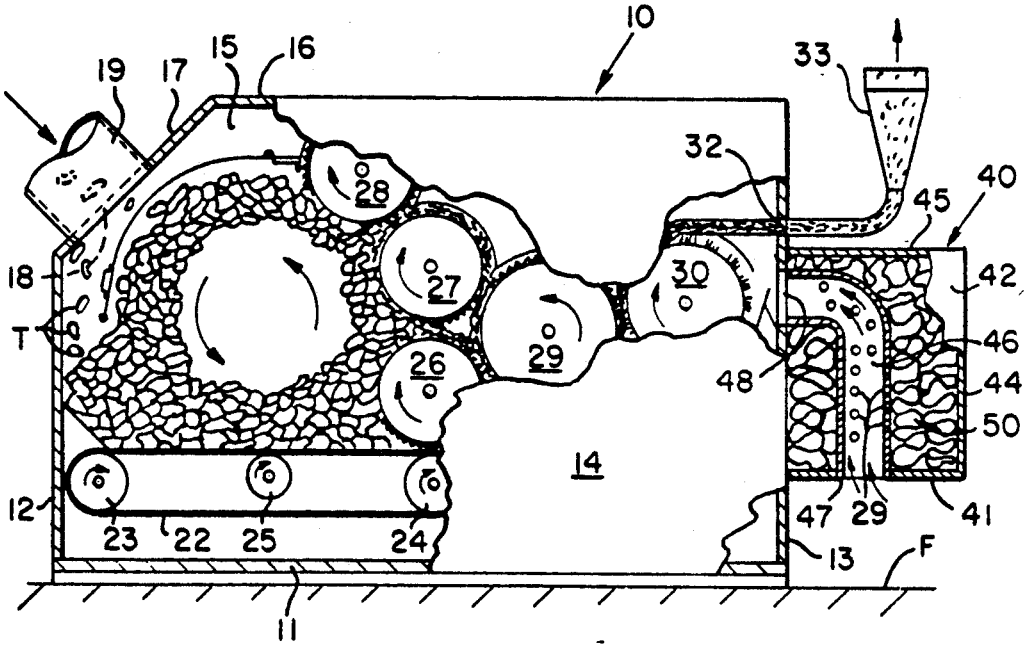
FIG. 2 is a fragmentary side elevation view of this machine with portions thereof broken away and shown in section.
Figure 3:
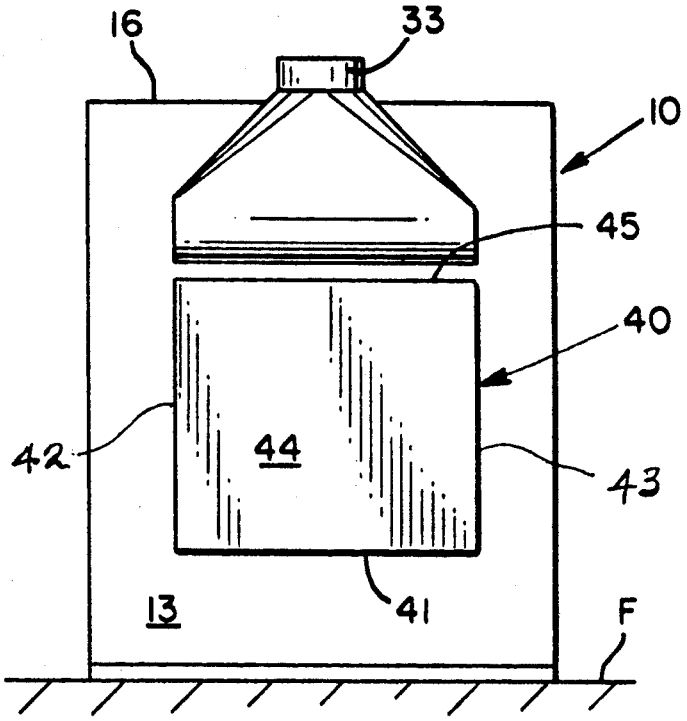
FIG. 3 is an end view of this machine as seen when looking toward the right end of the machine as shown in FIG. 2.

Referring now to the drawings by numerals of reference, 10 denotes a large, generally rectangularly shaped machine housing having a plane, flat bottom wall 11 that is disposed to be mounted horizontally on the floor F of a factory or the like, a pair of spaced, vertically disposed end walls 12 and 13, a pair of spaced, vertically disposed side walls 14 and 15 that extend at right angles between the end walls 12 and 13, and an integral top wall 16 that is supported on the upper edges of walls 13 to 15. Adjacent one end thereof (the left end as shown in FIG. 2) the top wall 16, which is somewhat shorter than the lower wall 11, is connected to the upper edge of the housing wall 12 by an inclined wall or housing section 17. Section 17 has therein a large opening 18, and which secured to one end of a duct 19 through which tufts T (FIG. 2) of fibers are inserted into the machine to be opened as noted hereinafter.

The machine enclosed within the housing 10 is a conventional fiber opening system, including a conveyor belt 22, which is mounted to rotate in an endless path around spaced, parallel, horizontally disposed drive rollers 23 and 24, and over an idler roller 25 which helps to maintain the upper run horizontal during operation of the equipment. As fiber tufts T are fed into the housing 10 through the inlet 19, they drop down onto the belt 22, which conveys them toward a first series (three) of vertically spaced, toothed opening rolls 26, 27 and 28. In the embodiment illustrated (FIG. 2) these rolls rotate clockwise about parallel axes, and in so doing cause portions of the tufts to pass between their nips to a larger, toothed roll or lickerin 29, which rotates counterclockwise about a horizontal axis. From roll 29 fibers pass over a feed roll or brush 30, which rotates clockwise about a horizontal axis adjacent and nearly tangentially of the roll 29. A stream of air, which is developed in housing 10 as noted hereinafter, assists in doffing opened fibers from the roll 30 and conveying the opened fibers in an air stream through an opening 32 in the housing end wall 13, and into the lower end of a penumatically operated fiber distribution duct 33. The opposite end of duct 33 may be connected in any known manner to a vacuum or suction source for a purpose noted hereinafter.

As thus far described, the housing 10 and machinery therein are conventional.

Secured approximately centrally to the outside of housing wall 13 beneath its opening 32 is a noise reduction housing or box 40, which also happens to be generally rectangular in configuration in the embodiment illustrated. Box 40 comprises a plane, flat bottom wall 41 spaced above and parallel to the housing bottom wall 11 and the floor F, spaced, parallel, vertically disposed side walls 42 and 43, and a vertically disposed end wall 44 which extends at right angles between the side walls 42 and 43. The box is closed at its upper end by a horizontal top wall 45, and at its left end (FIG. 2) by housing wall 13.

Secured within the housing 40 in spaced relation to its walls 42–45 is a generally right angularly shaped air inlet duct 46 having a lower, inlet end 47, which opens on the box bottom wall 41 substantially centrally thereof, and an upper, outlet end which registers with a central opening 48 in the housing wall 13. Duct 46, which may be cylindrical or otherwise in cross section, permits air to enter housing 10 during the operation of the machinery in order to create a stream of air which is drawn upwardly in housing 10 toward the opening 33 and into the lower end of duct 33. In so doing, this air stream helps to doff fiber from roll 30 and to convey such fibers into the duct 33 for distribution thereby to various web forming machines or the like.

In order to deaden or suppress any noise which might otherwise be developed in or around the box or unit 40 and the attached housing 10, the walls defining the duct 46 are provided with a plurality of spaced perforations, only certain of which are denoted by way of example at 49 in FIG. 2. In addition, the interior of box 40 around the outside of the duct 46 is packed with a sound absorbing foam insulation denoted at 50 in FIG. 2.

From the foregoing it will be apparent that the present invention provides relatively simple and inexpensive means for considerably reducing the amount of noise generated or emitted by fiber opening machinery of the type described. The noise reduction unit or box 40 has been found to reduce the noise produced at the air inlet to housing 10 from approximately ninety-six decibels to seventy-eight decibels. This 20% noise reduction substantially eliminates the possibility of any permanent damage to nearby employees. In larger installations where there may be dozens of machines of the type disclosed herein, the benefits formed from the use of noise reduction units of the type denoted at 40 are considerable.

While this invention has been illustrated and described in connection with only certain embodiments thereof, it will be apparent that it is capable of still further modification, and that this application is intended to cover any such modifications as may fall within the scope of one skilled in the art, or the appended claims.

We claim:

1. In a fiber processing machine including a first housing having adjacent one end thereof an inlet for receiving a supply of fiber tufts, adjacent an opposite end thereof a fiber outlet connected to a suction source, and intermediate the ends thereof a plurality of toothed rolls for opening fiber tufts, means exterior of said first housing for directing a stream of air through an air inlet opening in said first housing and into said fiber outlet, comprising an air inlet duct at the exterior of the first housing secured at one end over said air inlet opening in said first housing and communicating at an opposite end thereof with ambient air at the exterior of said housing, a second housing surrounding said air inlet duct in spaced relation to the outer surface of said air inlet duct, and sound absorbing means interposed in a space between said second housing and the outer surface of said air inlet duct.

2. The fiber processing machine as defined in claim 1, wherein said sound absorbing means comprises sound absorbing foam insulation substantially filling said space between said second housing and said air inlet duct.

3. The fiber processing machine as defined in claim 1, wherein said air inlet duct has therethrough intermediate the ends thereof a plurality of spaced perforations.

4. The fiber processing machine as defined in claim 1, wherein said second housing comprises a box-shaped casing having therein a first opening sealingly secured around a marginal edge thereof to the outside of the first housing over and in spaced relation to said air inlet duct, said air inlet duct has said opposite end thereof secured in registry with a second opening in said casing, and said air inlet duct has therethrough intermediate the ends thereof a plurality of spaced perforations.

5. The fiber processing machine as defined in claim 4, wherein said sound absorbing means comprises sound absorblng foam insulation surrounding said air inlet duct and substantially filling the space in said casing between the inside surface thereof and the outer surface of said air inlet duct.

6. The fiber processing machine, as defined in claim 5, wherein the portion of said foam insulation in said casing registering with said first opening in said casing is engaged with the outer surface of said first-named housing around said one end of said air inlet duct.

7. A fiber processing machine, comprising a housing having an inlet in one end for receiving tufts of fibers, and a fiber outlet in an opposite end thereof communicating with a suction source, a plurality of rotatable fiber opening rolls mounted in said housing intermediate the ends thereof for opening fiber tufts admitted through said inlet, and for feeding opened fibers toward said outlet, a noise suppression box secured on an exterior of said housing over an air inlet opening formed in said housing adjacent said fiber outlet, said box having mounted therein in spaced relation to the inside surface of said box an air inlet duct secured at one end in communication with said air inlet opening in said housing, and communicating at an opposite end thereof through an opening in said box with ambient air at the exterior of said housing, and sound absorbing means substantially filling a space in said box between the inside surface thereof and said air inlet duct.

8. A fiber processing machine as defined in claim 7, wherein said sound absorbing means comprises foam insulation packed in said space in said box.

9. A fiber processing machine as defined in claim 8, wherein said air inlet duct has therethrough intermediate the ends thereof a plurality of spaced perforations.

* * * * *